US010618108B2

(12) United States Patent
Nowak et al.

(10) Patent No.: US 10,618,108 B2
(45) Date of Patent: Apr. 14, 2020

(54) HOT RUNNER FEED SYSTEM FOR A DIECASTING MOULD

(71) Applicant: Oskar Frech GmbH + Co. KG, Schorndorf (DE)

(72) Inventors: Marc Nowak, Hannover (DE); Norbert Erhard, Lorch (DE); Ronny Aspacher, Schorndorf (DE)

(73) Assignee: Oskar Frech GmbH + Co. KG, Schorndorf (DE)

( * ) Notice: Subject to any disclaimer, the term of this patent is extended or adjusted under 35 U.S.C. 154(b) by 142 days.

(21) Appl. No.: 15/579,806

(22) PCT Filed: Jun. 3, 2016

(86) PCT No.: PCT/EP2016/062695
§ 371 (c)(1),
(2) Date: Dec. 5, 2017

(87) PCT Pub. No.: WO2016/193458
PCT Pub. Date: Dec. 8, 2016

(65) Prior Publication Data

US 2018/0354025 A1 Dec. 13, 2018

(30) Foreign Application Priority Data

Jun. 5, 2015 (DE) ..... 10 2015 210 400

(51) Int. Cl.
*B22D 17/22* (2006.01)
*B22C 9/08* (2006.01)
(Continued)

(52) U.S. Cl.
CPC ..... *B22D 17/2272* (2013.01); *B22C 9/082* (2013.01); *B22D 17/2209* (2013.01);
(Continued)

(58) Field of Classification Search
CPC ..... B22D 17/2272; B22D 17/2209; B22D 17/2218; B22D 17/32; B22D 17/2227;
(Continued)

(56) References Cited

U.S. PATENT DOCUMENTS 6,830,094 B2 12/2004 Fink
7,845,936 B2 12/2010 Babin
(Continued)

FOREIGN PATENT DOCUMENTS

CN 101357397 A 2/2009
CN 101365551 A 2/2009
(Continued)

OTHER PUBLICATIONS

English machine translation of Matsumura et al. JP-2002-263790A (Year: 2002).*
(Continued)

*Primary Examiner* — Kevin P Kerns
*Assistant Examiner* — Steven S Ha
(74) *Attorney, Agent, or Firm* — Crowell & Moring LLP

(57) ABSTRACT

A hot runner feed system is provided for a diecasting mold, wherein the feed system has a melt manifold and feed block construction having an entry-side feed inflow opening, at least one first and one second exit-side feed outflow opening which open into a mold separation plane between a fixed mold half and a movable mold half of the diecasting mold, and a casting runner-duct structure that extends so as to branch out from the feed inflow opening to the feed outflow openings. The melt manifold and feed block construction at least in an exit-side block region that includes the two feed outflow openings in a transverse direction parallel with the mold separation plane in relation to a predefined nominal operating extent is made so as to be shortened by an expansion dimension which has been predefined as a ther-
(Continued)

mal transverse expansion of this block region when heated from a room temperature range to a predefined operating temperature range that is elevated in relation to said room temperature range.

4 Claims, 5 Drawing Sheets

(51) Int. Cl.
*B22D 17/32* (2006.01)
*B22D 18/04* (2006.01)

(52) U.S. Cl.
CPC ..... *B22D 17/2218* (2013.01); *B22D 17/32* (2013.01); *B22D 17/2227* (2013.01); *B22D 18/04* (2013.01)

(58) Field of Classification Search
CPC ..... B22D 17/2281; B22D 18/04; B22C 9/08; B22C 9/082
See application file for complete search history.

(56) References Cited

U.S. PATENT DOCUMENTS

| | | | |
|---|---|---|---|
| 7,975,751 | B2 | 7/2011 | Gosch et al. |
| 8,104,529 | B2 | 1/2012 | Erhard et al. |
| 8,302,660 | B2 | 11/2012 | Erhard et al. |
| 8,690,563 | B2 | 4/2014 | Babin |
| 2005/0255189 | A1 | 11/2005 | Manda et al. |

FOREIGN PATENT DOCUMENTS

| | | | |
|---|---|---|---|
| CN | 101786315 | A | 7/2010 |
| CN | 201848524 | U | 6/2011 |
| CN | 103568219 | A | 2/2014 |
| DE | 840 905 | B | 6/1952 |
| DE | 10 2005 054 616 | B3 | 11/2006 |
| EP | 1 201 335 | A1 | 5/2002 |
| EP | 1 997 571 | B1 | 1/2011 |
| EP | 2 295 172 | B1 | 12/2014 |
| JP | 2001-30055 | A | 2/2001 |
| JP | 2002-263790 | A | 9/2002 |
| JP | 2003-39158 | A | 2/2003 |

OTHER PUBLICATIONS

English machine translation of Nakamura JP-2001-030055A (Year: 2001).*

L.H. Kallien et al., "Druckgiessen (Diecasting)", Giesserei, Jul. 2009, pp. 18-26, vol. 96.

International Search Report (PCT/ISA/210) issued in PCT Application No. PCT/EP2016/062695 dated Aug. 16, 2016 with English-language translation (five (5) pages).

Written Opinion (PCT/ISA/237) issued in PCT Application No. PCT/EP2016/062695 dated Aug. 16, 2016 with English-language translation (Eleven (11) pages).

Chinese-language Office Action issued in counterpart Chinese Application No. 201680042306.0 dated Mar. 4, 2019 (seven pages).

* cited by examiner

HOT RUNNER FEED SYSTEM FOR A DIECASTING MOULD

BACKGROUND AND SUMMARY OF THE INVENTION

The invention relates to a hot runner feed system (also called hot runner gating system or hot runner sprue system) for a diecasting mold, wherein the feed system includes a melt manifold and feed block construction having an entry-side feed inflow opening, at least one first and one second exit-side feed outflow opening which open into a mold separation plane between a fixed mold half and a movable mold half of the diecasting mold, and a casting runner-duct structure that extends so as to branch out from the feed inflow opening to the feed outflow openings.

A hot runner feed system by the applicant, having the trade name Frech-Gießlauf-System, or Frech-Gating-System (FGS), respectively, for diecasting molds, such as is also mentioned, for example, in the magazine essay Druckgießen (Diecasting) by L. H. Kallien and C. Böhnlein, Gießerei 96, 07/2009, pages 18 to 26, is commercially available. In general, hot runner feed systems as compared to other conventional feed systems have the advantage that the proportion of melt material which is allocated to the so-called ingate, or to the ingate region that is upstream of the mold cavity, respectively, and has to be severed from the cast casting, can be significantly reduced.

Hot runner feed systems by the applicant, which are, for example, of a comb-type or fan-type feed, or have dedicated feed block units having an integrated melt runner heating that are insertable into a respective mold, are disclosed in patent publications EP 1 201 335 B1 and EP 1 997 571 B1.

More recently, the demand for diecasting molds and associated feed systems which operate in a relatively high temperature range of up to approx. 750° C. has grown. At this elevated temperature, the risk of an undesirable formation of oxide and the risk of fire in the case of highly reactive and intensely oxidizing melts such as magnesium is increased in particular in exit opening regions of the feed system. A direction of approach for addressing these problems lies in a transition from comb and fan feed systems to systems having a fewer number of casting outflow openings that are of a larger dimension.

The layout of the hot runner feed system for said elevated temperature range compounds the difficulties which are associated with the thermal expansion of various components of the feed system and of the components that surround the latter, in particular of the adjacent parts of the fixed mold half and of the movable mold half. In particular, differences in the thermal expansion by virtue of the use of different materials for the respective components are also to be taken into account here. At the same time attention has to be paid to a reliable sealing of the feed system in order to prevent melt leakages by virtue of the lack of tightness in the system. Conventional seals such as used in hot runner systems of the mold construction for plastic injection molding that are conceived for a lower operating temperature range are not well suited to the elevated operating temperature range mentioned, not least because the seals not only have to reliably seal in the operating temperature range when the melt-conducting runners are at the liquidus temperature, but also have to survive the cooling process of the casting procedure when the system is still filled with melt and the latter solidifies as it cools in the runner.

In order for these problems to be overcome, the geometry and the temperature profile of the hot runner feed system are chosen such that the melt exits are preferably disposed so as to ascend and that a temperature gradient is set from a hot upstream region which is formed, for example, by a melt manifold region and depending on the melt material used is kept at an operating temperature of, for example, 380° C. to 700° C., to a less hot downstream region which is adjacent to a contour-imparting part of the mold that is formed by the fixed and by the movable mold half, having an operating temperature range of approx. 120° C. to 300° C. The temperature conditions described reinforce the range of problems in the thermal expansion of dissimilar and mutually adjacent system components.

Patent publication DE 10 2005 054 616 B3 discloses a permanent diecasting mold having a casting-die element that at least partially surrounds a mold cavity, and a diecasting mold insert which has an upper side that is assigned to the mold cavity, a basic element which in the case of a cold diecasting mold by way of a clearance sits in a receptacle of the casting-die element, and a supporting collar which in a form-fitting manner sits in a step of the receptacle that transitions to the mold cavity. An overall height of the supporting collar and of the basic element, by an undersize that is at least equal to a height dimension by way of which the basic element expands in the direction of height during casting, is smaller than a depth of the receptacle.

Patent publication DE 840 905 discloses an injection casting mold in which part of a mold cavity is disposed in an insert which is displaceable in the direction of the mold partition so that said insert can be centered in a self-acting manner in relation to an ejection mold, to which end the latter has a recess which fits into an end of the insert.

It is an object of the invention to provide a hot runner feed system of the type mentioned at the outset which in terms of process reliability is also advantageously suitable for comparatively high diecasting temperatures.

The invention achieves this and other objects by providing a hot runner feed system in which the melt manifold and feed block construction at least in an exit-side block region that includes the two or more feed outflow openings in a transverse direction parallel with the mold separation plane in relation to a predefined nominal operating extent is made so as to be shortened by an expansion dimension which has been predefined as the thermal transverse expansion of this block region when heated from a room temperature range to a predefined operating temperature range that is elevated in relation to said room temperature range. The thermal transverse expansion herein is understood to be a relative size, that is to say relative to a potential smaller thermal transverse expansion of neighboring system components such as, in particular, of a neighboring region of the fixed mold half.

By way of this measure according to the invention, the longitudinal expansion of the melt manifold and feed block construction is considered in a controlled manner in the particularly relevant exit-side region, said controlled manner including a pre-determination of the associated thermal expansion. The pre-determination can be performed by experiments and/or by means of a computed simulation as is known per se to a person skilled in the art, wherein the respective influence parameters represent input variables of this pre-determination and represent the respective diecasting mold observed, together with the parts relevant to the latter.

When the melt manifold and feed block construction is heated from room temperature to operating temperature, said melt manifold and feed block construction expands by precisely the expansion dimension by which the former has been made in a shortened manner, such that said melt manifold and feed block construction, in particular also by way of the exit-side block region thereof that includes the feed outflow openings, matches the adjacent system components, for example of the fixed mold half, in a gap-free and sealing manner. The sufficient tightness at the contact/connection points is preferably achieved by suitable material pairings in such a manner that the dissimilar coefficients of thermal expansion seal the system more tightly as the temperature increases. To this end, depending on the type of application, suitable temperature-dependent pretensions can be pre-computed and applied, and/or conical sealing faces can be utilized in the temperature range of the tool. The invention thus enables a diecasting-tight connection between the melt manifold and feed block construction on the one hand, and the fixed mold half, on the other hand, that is to say a connection that is sufficiently tight in relation to the diecasting melts, to be provided, without dedicated sealing elements having to be inevitably used to this end.

In one refinement of the invention, the melt manifold and feed block construction has an integral manifold and feed block that includes the casting runner-duct structure from the feed inflow opening up to the feed outflow openings and comprises the exit-side block region. This refinement in terms of the construction is advantageous in particular for systems having comparatively smaller dimensions and/or lower operating temperatures. On account of the integral construction, contact points to be sealed between a melt manifold region and a feed system region that adjoins the former at the exit side are dispensed with.

In one embodiment, the exit-side block region in the case of this integral manifold and feed block forms an elongate oval, in each case one feed outflow opening being located in the two end regions of said oval.

In another embodiment, the exit-side block region of this integral manifold and feed block is insertable into a receptacle of the fixed mold half, wherein the receptacle has a transverse extent that corresponds to the nominal operating extent of the exit-side block region.

In one refinement of the invention, the melt manifold and feed block construction has a melt manifold block that includes the entry-side feed inflow opening, and adjacent thereto a first feed block that includes the first feed outflow opening and a second feed block that includes the second feed outflow opening. In each case one feed insert which is on the fixed mold half so as to be displaceable in a transverse direction that is parallel with the mold separation plane and so as to be fixable to said fixed mold half is disposed on the first and on the second feed block. The respective system components in a state in which the former have not yet been heated to the operating temperature and are not fixed can be displaced in relation to one another, so as for said system components to be fixed to one another once the desired operating temperature range has been reached. The longitudinal expansion effects that are caused by the heating procedure can thus be absorbed. The tightness in the operating temperature range can be ensured by said fixing. Any existing intermediate spaces can optionally be covered or sealed, respectively, by an associated cover plate.

In one embodiment of this measure, the feed inserts are in each case assigned one wedge plate for bracing the feed inserts by wedging on the fixed mold half. This in terms of construction represents an advantageous method for fixing the feed inserts to the fixed mold half. In a further design embodiment, the feed inserts are displaceable along a connecting line of the first and the second feed outflow opening, and are capable of being braced by the wedge plates in a transverse direction that is perpendicular to said connecting line.

In one refinement of the invention, the melt manifold and feed block construction has a melt manifold block having a first exit nozzle that is assigned to the first feed outflow opening, and a second exit nozzle that is assigned to the second feed outflow opening, and an intermediate plate having nozzle fitting mouthpieces for fitting the exit nozzles in a centering manner. The intermediate plate herein is made having a mutual spacing of the nozzle fitting mouthpieces thereof that corresponds to an operating temperature spacing of the exit nozzles, while the melt manifold block is made having a spacing of the exit nozzles thereof that corresponds to a room temperature spacing that is smaller in comparison to the operating temperature spacing. This in terms of construction represents an advantageous implementation in particular also for systems having comparatively larger dimensions and higher operating temperatures, and an alternative to the implementation by way of displaceable and fixable feed inserts.

The intermediate plate by way of the nozzle fitting mouthpieces thereof represents the released position of the system in the so-called run-out position of the diecasting mold. The intermediate plate, after having been heated to the operating temperature, can be run on to an existing heating pack and onto the exit nozzles of the melt manifold block, on account of which said intermediate plate can brace and seal the exit nozzles. The intermediate plate thereafter can be arrested, whereupon the tool operates in this configuration until the operating temperature range is departed from again.

Advantageous embodiments of the invention are illustrated in the drawings and will be described hereunder. In the drawings:

BRIEF DESCRIPTION OF THE DRAWINGS

Figure 1:
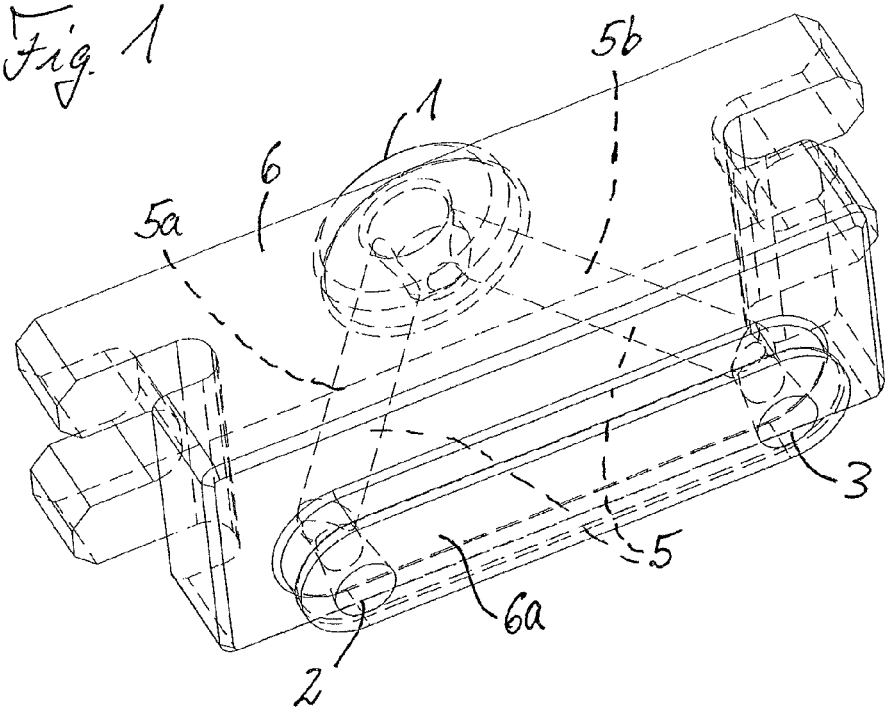
FIG. 1 shows a perspective view of an integral manifold and feed block of a hot runner feed system.

FIGS. 1 to 5 in some instances schematically show a hot runner feed system for a diecasting mold of an injection molding machine, having only the components thereof that are presently relevant. Otherwise, the feed system and the diecasting mold have one of the configurations thereof that are well-known to a person skilled in the art, this not requiring any further explanations herein. The hot runner feed system includes a melt manifold and feed block construction having an entry-side feed inflow opening 1, a first and a second exit-side feed outflow opening 2, 3 which open into a mold separation plane between a fixed mold half 4 and a movable mold half 20 of the diecasting mold, and a casting runner-duct structure 5 that extends so as to branch out from the feed inflow opening 1 to the feed outflow openings 2, 3. The casting runner-duct structure 5 in the example shown includes two runner ducts 5*a*, 5*b* which in terms of flow technology run parallel and conjointly emanate from the feed inflow opening 1, one of said runner ducts 5*a*, 5*b* leading to a feed outflow opening 2 and the other leading to the other feed outflow opening 3. A mouthpiece nozzle of an upstream part of the feed system such as of a casting chamber or of a riser, can be fitted in the usual manner to the feed inflow opening 1.

The melt manifold and feed block construction in the exemplary embodiment of FIGS. 1 to 5 has an integral manifold and feed block 6 that includes the casting runner-duct structure 5 from the feed inflow opening 1 to the feed outflow openings 2, 3. An exit-side block region 6*a* of the manifold and feed block 6 is configured as an elongate oval, wherein the two feed outflow openings 2, 3 are located at opposite end regions of the oval, as shown. The manifold and feed block 6 is disposed on the fixed mold half 4 in such a manner that the former by way of the exit-side oval 6*a* thereof lies in an elongate oval receptacle 7 of the fixed mold half 4 of identical shape. A respective entry region 25, 26 of the movable mold half 20, or of the mold cavity that is formed by the two mold halves 4, 20, respectively, communicates with each of the feed outflow openings 2, 3.

Figure 2:
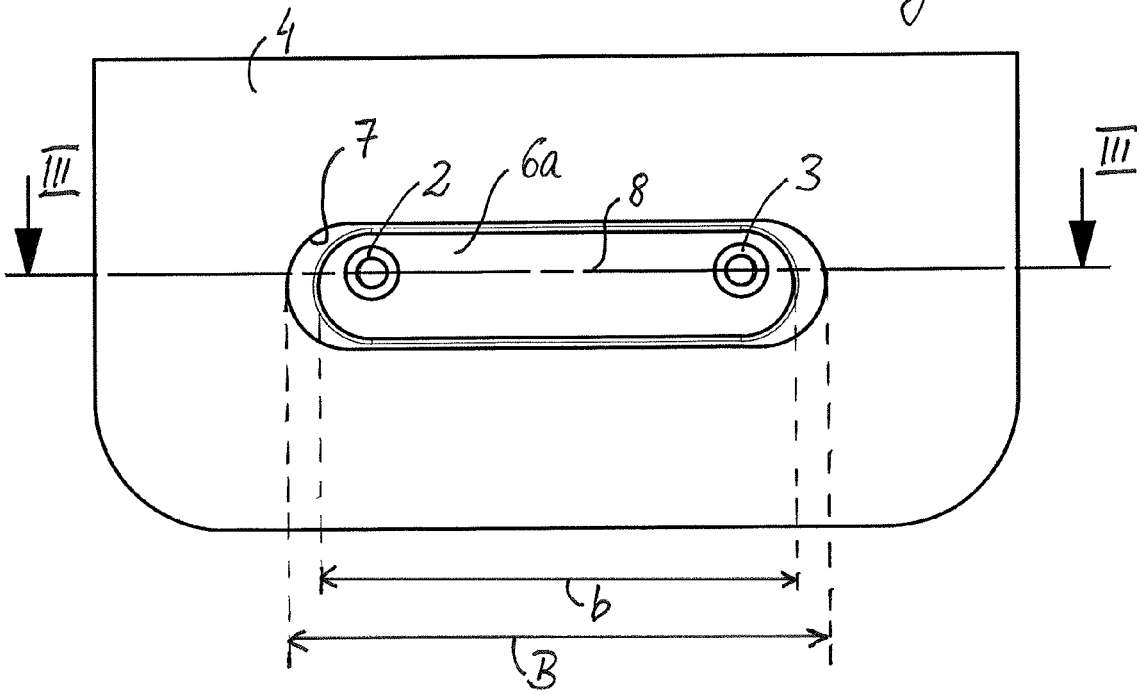
FIG. 2 shows a fragmented schematic plan view of a fixed mold half of a diecasting mold having a hot runner feed system having the manifold and feed block of FIG. 1, in a room temperature state.
Figure 3:
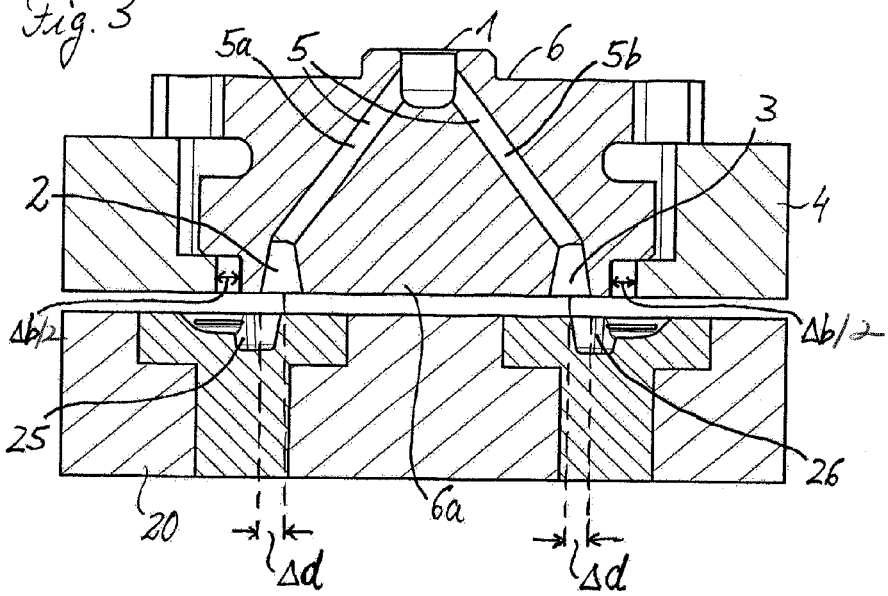
FIG. 3 shows a sectional view along a line of FIG. 2.

Characteristically, the manifold and feed block 6 by way of the exit-side oval block region 6*a* thereof in a transverse direction that is perpendicular to the mold separation plane in relation to a predefined nominal operating extent B is made so as to be shortened by an expansion dimension Δb to an expansion b=B−Δb. The expansion dimension Δb is characteristically controlled as the thermal transverse expansion of this oval block region 6*a* when heated from a room temperature range to a predefined operating temperature range that is elevated in relation to said room temperature range. FIGS. 2 and 3 show the installed oval block region 6*a* in the completed shortened expansion b thereof such as is present at room temperature. The expansion dimension Δb is pre-determined by experiments, depending on the melt material to be cast and the other parameters which have an influence on the thermal expansion behavior of the system components that are relevant herein, such as by respective tests or test series, respectively, and/or by computer simulation as is known per se to a person skilled in the art by solving other problems. Above all, metal melts from non-ferrous alloys such as based on magnesium, aluminum, zinc, tin, lead, and brass, but also salt melts, are to be mentioned as melt materials. The hot runner feed system herein can in particular also be conceived for comparatively high operating temperatures of more than 600° C. and, in corresponding applications, also up to 700° C. or 750° C. A deviation dimension by which the position of the feed outflow openings 2, 3 deviates in parallel with the mold separation plane from the position of the entry regions 25, 26 at room temperature corresponds to the expansion dimension.

The pre-determination of the expansion dimension Δb of the manifold and feed block 6, and in particular of the exit-side oval block region 6*a* thereof, enables a tight fit between mutually adjacent parts to be achieved without the risk of melt leakages, wherein usual seals can be dispensed with fully or at least to some extent. When the manifold and feed block 6 is brought from room temperature up to the predefined operating temperature, said manifold and feed block 6 according to the pre-determined expansion dimension Δb expands more in the transverse direction than the surrounding region of the fixed mold half 4. In a manner matching this, the corresponding receptacle 7 in the fixed mold half 4 is made larger than the oval block region 6*a* that is received by the expansion dimension Δb, that is to say in the example of FIG. 2 the receptacle 7 in the transverse direction along a connecting line 8 of the two feed outflow openings 2, 3 has a width B which by the expansion dimension Δb is larger than the expansion b of the oval block region 6*a* in this direction. In most instances, the change in the thermal expansion of the fixed mold half 4, and especially of the recess 7 thereof, is practically negligible in relation to the change in the thermal expansion of the oval feed block region 6*a*. Apart therefrom, it is understood that the pre-determined expansion dimension Δb is always the difference in the change of the thermal expansion of the mutually opposite system components or components, respectively.

Figure 4:
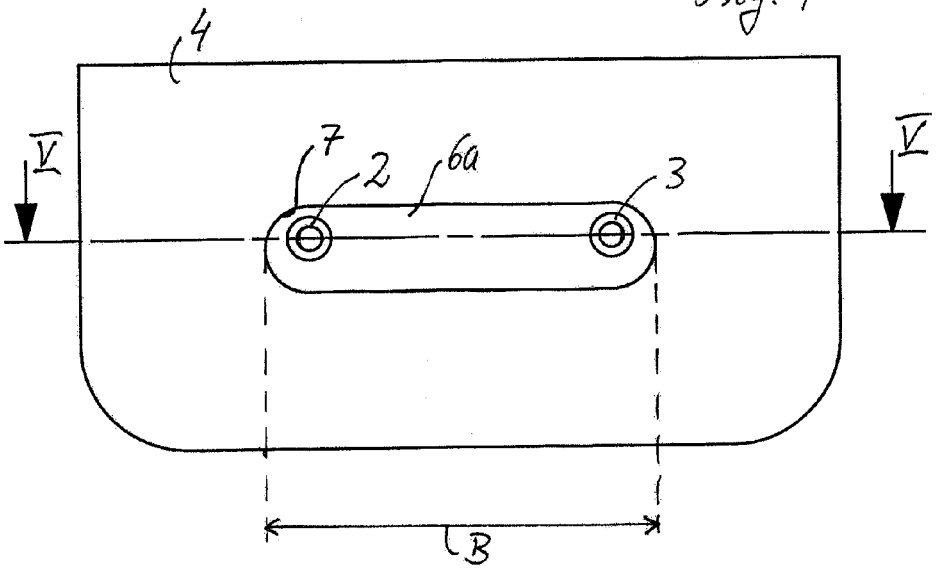
FIG. 4 shows the view of FIG. 2 in an operating temperature state.
Figure 5:
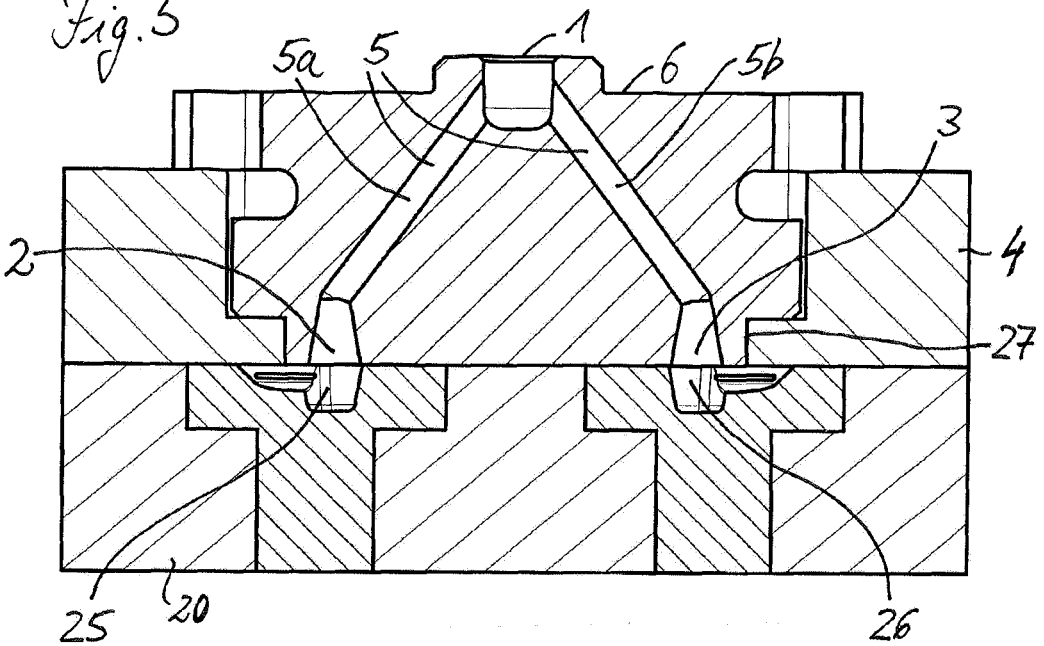
FIG. 5 shows a sectional view along a line V-V of FIG. 4.

FIGS. 4 and 5 show the system in the view of FIG. 2 or 3, respectively, once the heating of the manifold and feed block 6 to the predefined desired operating temperature range has been completed. The oval block region 6*a*, on account of having been heated, has expanded by the pre-determined expansion dimension Δb and, on account thereof, fills the receptacle 7 that is assigned thereto in the fixed mold half 4 in an exact fit and in a sealing manner, that is to say said oval block region 6*a* on account of the thermal expansion thereof presses against the periphery of the corresponding receptacle 7 thereof in a gap free and sealing manner and so as to be parallel with the mold separation plane on all sides. In particular, the gap dimension Δb that exists in the cold state is reduced to zero, that is to say that the manifold and feed block 6 in the region of the feed outflow openings 2, 3 thereof by way of a diecasting-tight connection 27 bears on the adjacent region of the fixed mold half 4. A diecasting-tight connection herein is to be understood as a gap-free tight connection that is sufficient for the application in diecasting and which prevents that liquid hot melt material can infiltrate the respective components, said connection in the exemplary embodiment of FIGS. 1 to 5 being analogous to an interference fit. The required and desired sealing of the system for subsequent casting procedures is thus provided.

At the same time, the deviation dimension Δd of the position of the feed outflow openings 2, 3 in relation to the entry regions 25, 26, on account of the dissimilar thermal expansion of said components when heated to the operating temperature is preferably likewise reduced to zero or almost zero, such that each feed outflow opening 2, 3 in a desired manner lies sufficiently aligned opposite the associated entry region 25, 26. It is thus guaranteed that the ingate of the melt on the manifold and feed block 6 that is operated at a melting temperature of, for example, 380° C. to 700° C., despite the dissimilar thermal expansion in relation to the fixed and to the movable mold half 4, 20 which is kept at an operating temperature of, for example, 120° C. to 300° C., lies precisely at the desired required location in terms of the mold that is defined by the two mold halves, and that this location despite the dissimilar thermal expansion of the mold that is temperature-controlled to, for example, 120° C.

to 300° C., on the one hand, and of the casting runner-duct structure 5 that is temperature-controlled to, for example, 380° C. to 700° C., on the other hand, is sufficiently tight in relation to the liquid metal melt used, considering the viscosity of the latter and the melt pressure of, for example, approx. 300 bar and more, for example up to approx. 450 bar, used.

Since the manifold and feed block 6 is made in an integral manner, there are no separation points between a melt transverse manifold region and a melt outlet nozzle region that are to be sealed in the case of the hot runner feed system of FIGS. 1 to 5. The melt is transferred from the feed inflow opening 1 as the central inlet and feed point of a nozzle of an upstream casting system of the machine, by way of the casting runner ducts 5*a*, 5*b* that preferably run obliquely in an outward and upward manner, directly into the outlet geometry of the oval exit region 6*a*.

Figure 6:
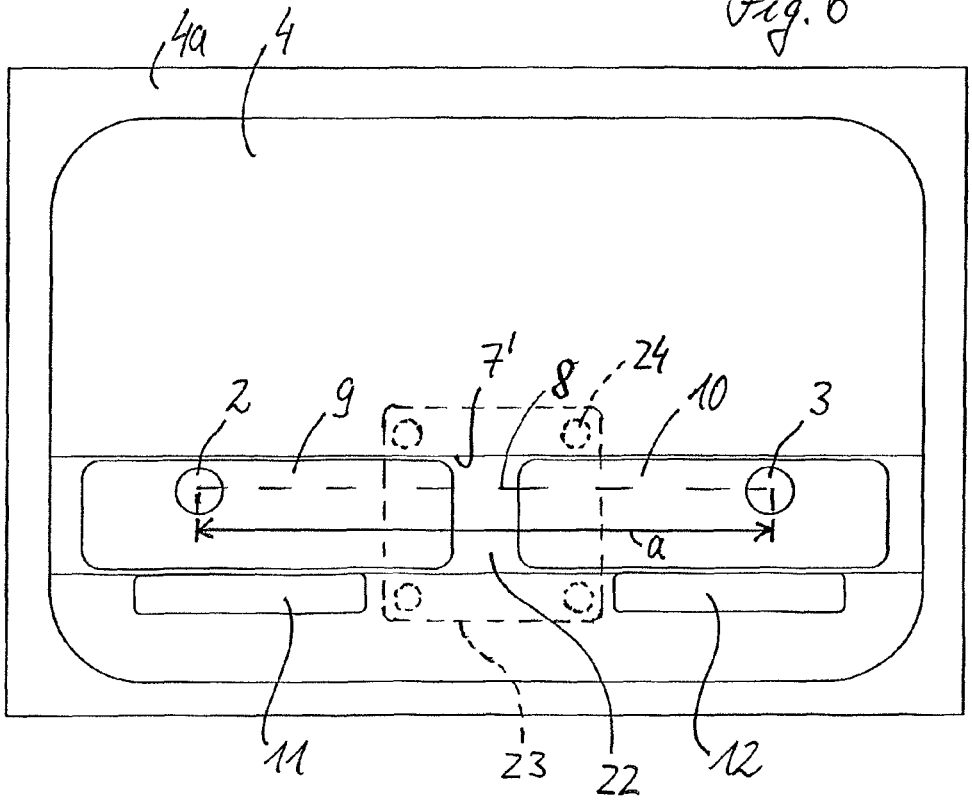
FIG. 6 shows a schematic plan view of a fixed mold half having a hot runner feed system that is attached thereto, said hot runner feed system on the exit side having displaceable feed inserts, in a room temperature state.
Figure 7:
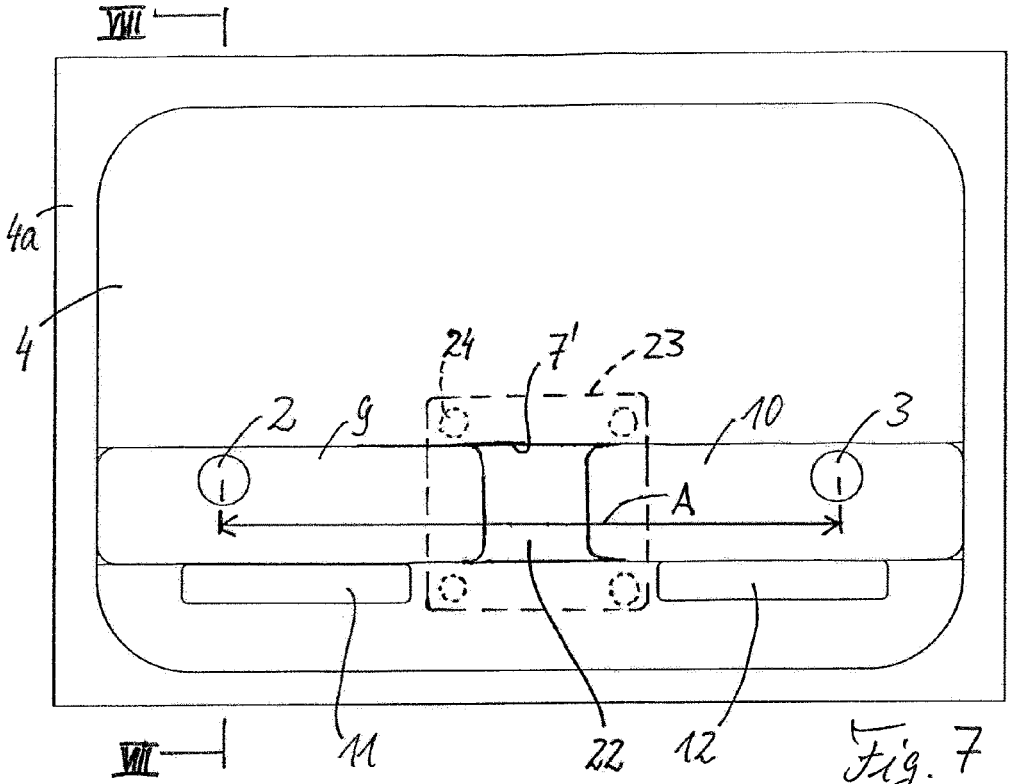
FIG. 7 shows the view of FIG. 6 in an operating temperature state.
Figure 8:
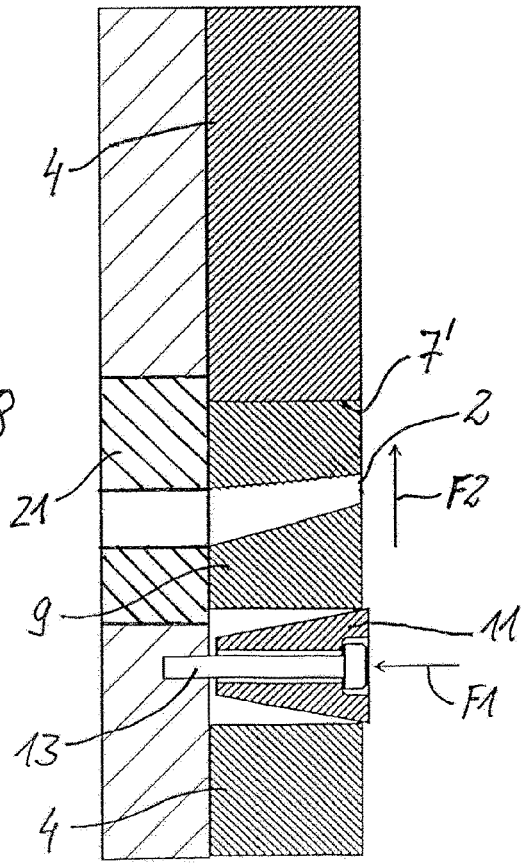
FIG. 8 shows a schematic sectional view along a line VI-VI of FIG. 7.

FIGS. 6 to 8 visualize a further potential implementation of the hot runner feed system according to the invention. This feed system includes a melt manifold and feed block construction which with the exception of the points of differentiation highlighted hereunder in terms of the configuration thereof can correspond to that of the feed system of FIGS. 1 to 5, or be similar to the latter. This relates in particular to the entry-side feed inflow opening, to the two exit-side feed outflow openings 2, 3, and to the casting runner-duct structure that extends so as to branch out from the feed inflow opening to the feed outflow openings. For improved understanding, the same reference signs herein are used not only for identical elements but also for elements which are equivalent in terms of function. As opposed to the integral manifold and feed block 6 in the case of the system of FIGS. 1 to 5, the melt manifold and feed block construction of the system of FIGS. 6 to 8 includes an embodiment in multiple parts, having a melt manifold block 21 which is known per se and which includes the feed inflow opening and which can only be partially seen in FIG. 8, and having two feed blocks or feed inserts 9, 10, respectively, that in terms of flow technology are connected in parallel with said melt manifold block 21, one of said feed blocks or feed inserts 9, 10, respectively, at the exit side having the first feed outflow opening 2, and the other at the exit side having the second feed outflow opening 3.

The feed inserts 9, 10 are disposed on the fixed mold half 4 so as to be displaceable in a transverse direction that is parallel with the mold separation plane and so as to be fixable to said fixed mold half 4, wherein the transverse direction here again is parallel with the connecting line 8 between the two feed outflow openings 2, 3. The two feed inserts 9, 10 by way of which the melt manifold and feed block construction thus terminates at the mold side and which include the feed outflow openings 2, 3, in the example shown in the plan view have an elongated rectangular shape and are displaceable along a strip-shaped receptacle region 7' on the fixed mold half 4. On account thereof, the respective thermal longitudinal expansion can be compensated in the case of this exemplary embodiment. Said thermal longitudinal expansion in FIGS. 6 and 7 is represented by the mutual spacing of the two feed outflow openings 2, 3 which from a room temperature spacing value a is increased to an operating temperature spacing value A when the system is heated to the operating temperature, said operating temperature spacing value A being larger than the room temperature spacing value a by the respective expansion dimension $\Delta a = A - a$.

When the system is heated to the operating temperature, the feed inserts 9, 10 remain in a non-fixed loose state such that said feed inserts can thermally expand, on account of which the feed outflow openings 2, 3 diverge in a corresponding manner. When the operating temperature range has been reached, the feed inserts 9, 10 in the transverse direction that is parallel with the connecting line 8 have expanded so far that the feed outflow openings 2, 3 have assumed the increased operating temperature spacing value A thereof. The feed inserts 9, 10 in the operating temperature state thereof shown in FIG. 7 are then fixed to the fixed mold half 4. An intermediate space 22 that exists between the feed inserts 9, 10 can be covered by a cover or fastening plate 23, respectively, which is optional and is therefore indicated by dashed lines in FIGS. 6 and 7 and can be secured to the fixed mold half 4, for example, by way of four fastening points 24 which are indicated by dashed lines. If required, an undesirable ingress of melt material and any other disturbing particles into the intermediate space 22 can be prevented by way of the cover plate 23.

Two wedge plates 11, 12 which are provided with wedge-shaped ramp faces, as can be seen in FIG. 8, and can be placed between a lower side of the respective feed insert 9, 10 and a portion of the fixed mold half 4 lying thereunder and can be fixed to the fixed mold half 4, in the example shown by means of a screw connection 13, are provided for fixing the feed inserts 9, 10 in the example shown. Fixing the respective wedge plates 11, 12 by virtue of a respective wedge-plate fixing force F1 by virtue of the wedge-shaped ramp faces of the wedge plates 11, 12 leads to a bracing force F2 acting on the adjacent feed insert 9, 10, said bracing force F2 being directed so as to be perpendicular to the displacement direction of the feed inserts 9, 10 and parallel with the mold separation plane. In this way, the feed inserts 9, 10 are fixed to the fixed mold half 4 in a reliable, gap-free manner and so as to be sealed by way of a material pairing.

Preferably, while not mandatorily, the expansion dimension by way of which the exit-side block region of the melt manifold and feed block construction having the feed inserts 9, 10 in a transverse direction parallel with the mold separation plane is made so as to be shortened in relation to a predefined nominal operating extent is pre-determined experimentally by means of tests and/or by calculation by means of a computer simulation as the thermal transverse expansion of said exit-side block region when heated from room temperature to the predefined operating temperature range also in the case of the exemplary embodiment of FIGS. 6 to 8. The pre-determination can be implemented in such a manner, for example, that the feed inserts 9, 10 by way of the external sides thereof that face away from one another bear against an adjacent portion of a mold frame 4*a* of the fixed mold half 4, as illustrated in FIG. 7. Otherwise, the advantageous consequences and effects that have been mentioned above in the context of the exemplary embodiment of FIGS. 1 to 5 apply in an analogous manner to the exemplary embodiment of FIGS. 6 to 8, wherein reference can be made to said earlier figures. This applies in particular also with a view to achieving a diecasting-tight connection between the melt manifold and feed block construction 9, 10, 21, on the one hand, and the surrounding region of the fixed mold half 4, on the other hand, which here is achieved by fixing the feed inserts 9, 10 in a fixed manner to the fixed mold half 4 at the operating temperature.

Figure 9:
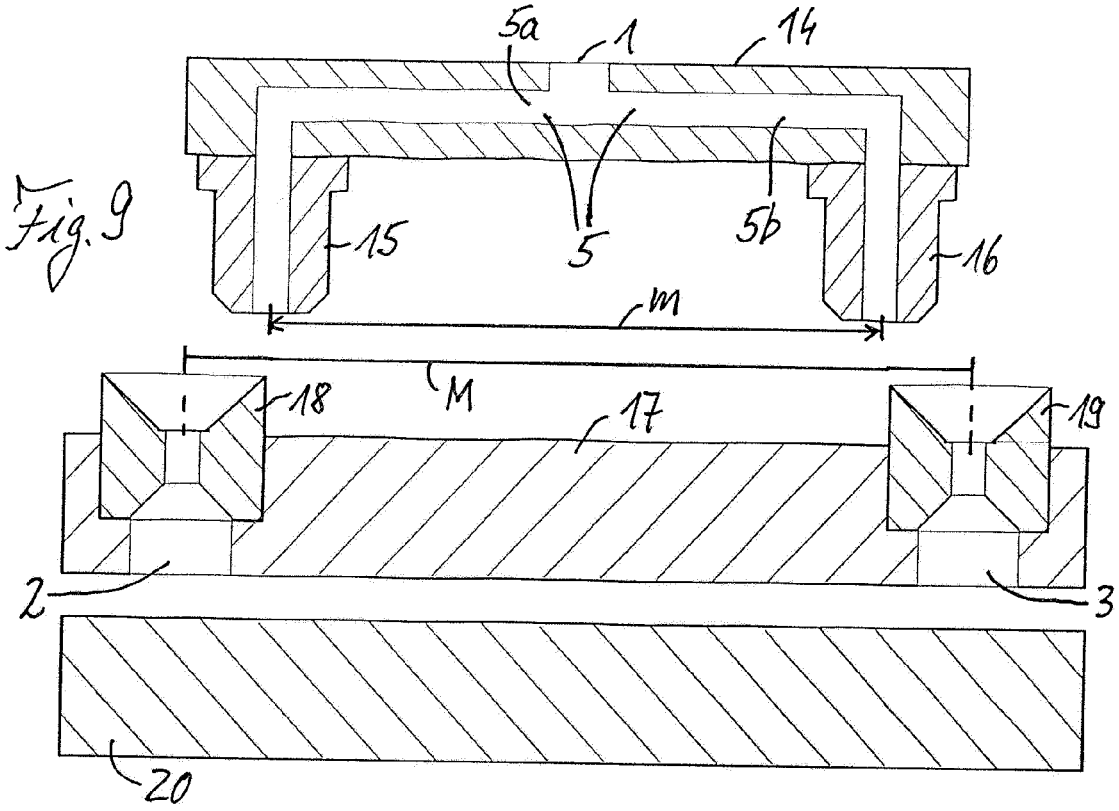
FIG. 9 shows a schematic perspective sectional view of a melt manifold and feed block construction having an exit-side intermediate place in front of a movable mold half, in a room temperature state.
Figure 10:
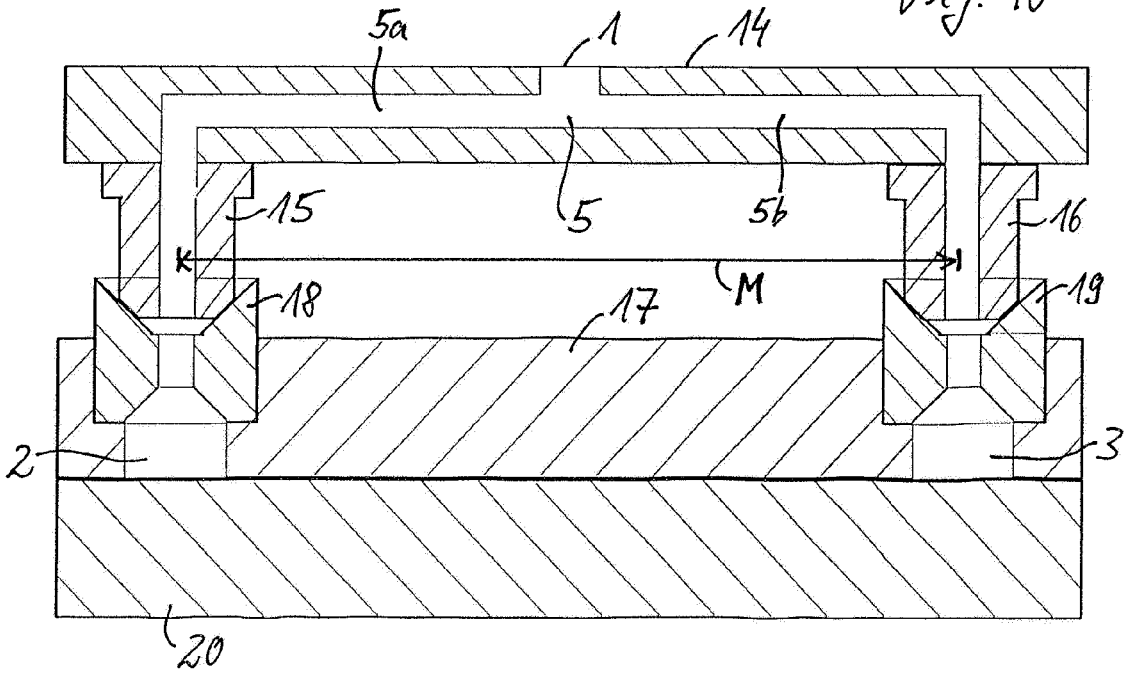
FIG. 10 shows the view of FIG. 9 in an operating temperature state.

FIGS. 9 and 10 schematically show a further advantageous implementation of the hot runner feed system according to the invention, having the components thereof that are of interest here. In the case of this feed system, the melt manifold and feed block construction comprises a melt manifold block 14 to which a first exit nozzle 15 and a second exit nozzle 16 are assigned on the exit side, and an intermediate plate 17 having nozzle fitting mouthpieces 18, 19 for fitting the exit nozzles 15, 16 in a centering manner. The first exit nozzle 15 is assigned to the first feed outflow opening 2 which continues through the nozzle fitting mouthpiece 18 and the intermediate plate 17. In an analogous manner, the second exit nozzle 16 is assigned to the second feed outflow opening 3 which continues through the nozzle fitting mouthpiece 19 and the intermediate plate 17. The intermediate plate 17 conjointly with the mouthpieces 18, 19 thus forms here an exit-side block region of the melt manifold and feed block construction. Said intermediate plate 17 is made so as to have a mutual spacing M of the nozzle fitting mouthpieces 18, 19, said spacing M corresponding to a mutual operating temperature spacing of the exit nozzles 15, 16, while the melt manifold block 14 is made so as to have a spacing m of the exit nozzles 15, 16, said spacing m corresponding to a room temperature spacing m which is smaller in relation to the operating temperature spacing M, as is illustrated in FIG. 9.

Consequently, the difference $\Delta m = M - m$ again represents the expansion dimension by which the exit-side block region of the melt manifold and feed block construction, presently the manifold block 14 having the exit-side exit nozzles 15, 16, thereof, in a transverse direction parallel with the mold separation plane is made so as to be shortened in relation to a predefined nominal operating extent. In this case too, the expansion dimension $\Delta m$ is pre-determined by means of tests and/or computer simulation as the thermal transverse expansion of this block region when heated from the room temperature range to the desired operating temperature range.

Prior to the casting operation, the melt manifold block 14 conjointly with the exit nozzles 15, 16 thereof is first brought to the desired operating temperature range. Said melt manifold block 14 herein is thermally expanded on account of which the spacing of the exit nozzles 15, 16 increases from the room temperature spacing value m to the operating temperature spacing value M. Now the intermediate plate 17 by way of the nozzle fitting mouthpieces 18, 19 thereof is brought to bear on the melt manifold block 14 that has been brought to the operating temperature, wherein the mouthpieces 18, 19 in this instance have the same mutual spacing as the two exit nozzles 15, 16, such that the exit nozzles 15, 16 can readily make their way into the conical introduction regions of the nozzle fitting mouthpieces 18, 19.

On account of the corresponding conical oblique face design of the front side of the exit nozzles 15, 16, on the one hand, and of the entry-side faces of the mouthpieces 18, 19, on the other hand, the exit nozzles 15, 16 are reliably received and braced in the nozzle fitting mouthpieces 18, 19 of the intermediate plate 17 in a gap-free sealing manner while forming a planar or at least linear sealing effect. The intermediate plate 17 is now fixed to the fixed mold half and in subsequent casting in the respective region forms a contact face to an opposite movable mold half 20. FIG. 10 shows the assembly in this operation-ready mounted state when brought up to the operating temperature.

As is highlighted by the exemplary embodiments shown and explained above, the invention makes available a very advantageous hot runner feed system having a characteristic expansion compensation. It is to be understood that the invention comprises numerous other potentials for implementation, for example feed systems having more than two, for example three or four, exit-side feed outflow openings, and/or a casting runner-duct structure that branches off in a different manner. The hot runner feed system according to the invention is particularly suitable for casting a multiplicity of non-ferrous alloys in corresponding temperature ranges from typically between 300° C. and 700° C., for example for casting magnesium, zinc, aluminum, tin, lead, and brass, but also salt melts, for example at temperatures of more than 700° C. Longitudinal expansions of the system when heating up are compensated, in particular in a controlled manner by pre-determining a respective expansion dimension and considering the latter as a shortening in production. The heated system parts in terms of construction can thus be incorporated in the mold such that said system parts can reliably absorb the forces of the mold locking mechanism and of the melt pressure. The tightness at the contact/connection points is preferably achieved by suitable material pairings in relation to steel, to which end the dissimilar thermal expansion coefficient can contribute. To this end, suitable pretensions depending on the temperature can be pre-calculated. Moreover, conical sealing faces can be utilized in the temperature range of the tool. Steel-to-steel material pairings from dissimilar steel alloys can also be used in corresponding types of application.

Sensors for controlling the temperature are preferably employed at suitable locations of the tool such that the heating installations used can be controlled or regulated, respectively, in a corresponding manner, as is known per se to a person skilled in the art. In particular, it is possible to set and maintain, if required, a pre-definable temperature profile along the melt flow path of the casting runner-duct structure. A temperature profile of this type can include, for example, a comparatively hot entry-side region in the melt manifold portion, and an exit-side region that in relation to the former is not heated or less heated and which can function as a transient region from the melt manifold region that is heated to, for example, more than 600° C., to the contour-imparting part of the mold which, for example, is approx. 80° to approx. 380° C., preferably 100° C. to 300° C. The lower temperature in the transient region lowers the reactivity in the case of heavily oxidizing melts and, for example, in the case of magnesium also lowers the risk of fire such that the melt in the casting cycle does not mandatorily have to be impinged with an inert gas in the mold.

What is claimed is:

1. A hot runner feed system for a diecasting mold, comprising:

a melt manifold and feed block construction having an entry-side feed inflow opening, first and second exit-side feed outflow openings which open into a mold separation plane between a fixed and a movable mold half of the diecasting mold, and a casting runner-duct structure that extends so as to branch out from the entry-side feed inflow opening to the first and second exit-side feed outflow openings, wherein the melt manifold and feed block construction in an exit-side block region that includes the first and second feed outflow openings in a transverse direction parallel with the mold separation plane in relation to a predefined nominal operating extent is made so as to be shortened by an expansion dimension which has been predefined as a thermal transverse expansion of this block region when heated from a room temperature range to a predefined operating temperature range that is elevated in relation to said room temperature range, wherein the melt manifold and feed block construction comprises a melt manifold block that includes the entry-side feed inflow opening, and adjacent thereto a first feed insert that includes the first feed outflow opening and a second feed insert that includes the second feed outflow opening, wherein the feed inserts are disposed on the fixed mold half so as to be displaceable in a transverse direction that is parallel with the mold separation plane and so as to be fixable to said fixed mold half.

2. The hot runner feed system as claimed in claim 1, wherein the feed inserts are in each case assigned a wedge plate for bracing the feed inserts by wedging on the fixed mold half.

3. The hot runner feed system as claimed in claim 2, wherein the feed inserts are displaceable along a connecting line of the first and the second feed outflow opening, and are capable of being braced by the wedge plates in a transverse direction that is perpendicular to said connecting line.

4. A hot runner feed system for a diecasting mold, comprising:

a melt manifold and feed block construction having an entry-side feed inflow opening, first and second exit-side feed outflow openings which open into a mold separation plane between a fixed and a movable mold half of the diecasting mold, and a casting runner-duct structure that extends so as to branch out from the entry-side feed inflow opening to the first and second feed outflow openings, wherein the melt manifold and feed block construction in an exit-side block region that includes the first and second feed outflow openings in a transverse direction parallel with the mold separation plane in relation to a predefined nominal operating extent is made so as to be shortened by an expansion dimension which has been predefined as a thermal transverse expansion of this block region when heated from a room temperature range to a predefined operating temperature range that is elevated in relation to said room temperature range, wherein the melt manifold and feed block construction comprises a melt manifold block having a first exit nozzle that is assigned to the first feed outflow opening, and a second exit nozzle that is assigned to the second feed outflow opening, and an intermediate plate having nozzle fitting mouthpieces for fitting the exit nozzles in a centering manner, wherein the intermediate plate is configured to be fixed to the fixed mold half, the intermediate plate is made having a mutual spacing of the nozzle fitting mouthpieces that corresponds to an operating temperature spacing of the exit nozzles, and the melt manifold block is made having a spacing of the exit nozzles that corresponds to a room temperature spacing that is smaller in comparison to the operating temperature spacing.

* * * * *